US005697210A

United States Patent [19]

Kawauchi

[11] Patent Number: 5,697,210

[45] Date of Patent: Dec. 16, 1997

[54] FULLY-FIRED COMBINED GAS TURBINE WITH INDEPENDENTLY OPERABLE BOILER AND VENTILATOR

[75] Inventor: Akihiro Kawauchi, Hitachi, Japan

[73] Assignee: Hitachi, Ltd., Tokyo, Japan

[21] Appl. No.: 518,292

[22] Filed: Aug. 15, 1995

[30] Foreign Application Priority Data

Aug. 31, 1994 [JP] Japan ..... 6-206336

[51] Int. Cl.[6] ..... F02C 6/00

[52] U.S. Cl. ..... 60/39.182; 60/39.5; 60/39.511; 122/7 R

[58] Field of Search ..... 60/39.182, 39.5, 60/39.511; 122/7 R

[56] References Cited

U.S. PATENT DOCUMENTS

| | | | |
|---|---|---|---|
| 3,118,429 | 1/1964 | Hochmuth | 60/39.182 |
| 3,280,551 | 10/1966 | Bracken et al. | 60/39.182 |
| 4,125,996 | 11/1978 | Schmoch | 60/39.182 |
| 4,362,013 | 12/1982 | Kuribayashi | 60/39.182 |
| 4,437,313 | 3/1984 | Taber et al. | 60/39.182 |
| 4,720,968 | 1/1988 | Knizia | 60/39.511 |
| 4,784,069 | 11/1988 | Stark | 60/39.5 |
| 5,078,752 | 1/1992 | Mach et al. | 60/39.182 |
| 5,285,629 | 2/1994 | Gounder | 60/39.182 |
| 5,375,410 | 12/1994 | Briesch et al. | 60/39.182 |

OTHER PUBLICATIONS

Mitsubishi Jyuko Technical Report, vol. 28, No. 1, (1991–1).

*Primary Examiner*—Timothy Thorpe
*Assistant Examiner*—Ted Kim
*Attorney, Agent, or Firm*—Fay, Sharpe, Beall, Fagan, Minnich & McKee

[57] ABSTRACT

A fully-fired combined plant includes a boiler, a boiler feed air line provided with an air heater for feeding heated air to the boiler, a gas turbine, a gas turbine exhaust gas line connected to the gas turbine and the boiler feed air line downstream of the air heater for feeding exhaust gas from the gas turbine into the boiler feed air line. A shutter is provided on the gas turbine exhaust gas line for shutting the line at the time the operation of the gas turbine is stopped, and a ventilator is provided on the gas turbine exhaust gas line on the upstream side of the shutter with respect to a gas turbine exhaust gas flow for ventilating the gas turbine exhaust gas line on the upstream side of the shutter.

13 Claims, 5 Drawing Sheets

FULLY-FIRED COMBINED GAS TURBINE WITH INDEPENDENTLY OPERABLE BOILER AND VENTILATOR

BACKGROUND OF THE INVENTION

This invention relates to a power plant such as a fully-fired combined plant having lines in which a gas turbine exhaust gas line is connected to gas and air ducts of other power plant equipment such as a boiler more particularly the invention relates, to a fully-fired combined plant in which a gas turbine thereof is protected from high-temperature air and maintenance and inspection of the gas turbine can be practiced safely.

A conventional fully-fired combined plant has a stack provided on a gas turbine exhaust gas line for exclusive use of a gas turbine. This equipment is provided, taking into consideration a gas turbine operation at the time of its start-up or shut-down and a gas turbine independent operation, for discharging gas turbine exhaust gas to atmosphere without purifying treatment, which is disclosed in Mitsubishi Jyuko Technical Report Vol. 28 No. 1 (1991-1). The cost of the equipment is large and a lot of atmosphere contaminant substances such as nitrogen oxides are emitted to the atmosphere.

When the gas turbine is stopped, the boiler gas and air ducts and the gas turbine exhaust gas line are separated by means of a damper. During operation of the boiler, however, air leaks through the damper and the leaked gas is exhausted through a stack for exclusive use of the gas turbine.

In order to satisfy an electric power demand rapidly increasing nowadays, plans and constructions of fully-fired combined plants are in progress. In view of worldwide environmental deterioration restrictions, installation of the above-mentioned stack for exclusive use of the gas turbine is difficult because gas turbine exhaust gas is wasted from the stack without being purified.

In a fully-fired combined plant, exhaust gas of the gas turbine is used as combustion air for the boiler. Therefore, a gas turbine exhaust gas line is connected with boiler gas and air ducts. In particular, in case the gas turbine exhaust gas line is connected with the boiler air duct or a boiler air feed line on the outlet side of a forced draft fan provided thereon, when the gas turbine is stopped during a boiler independent operation and maintenance and inspection of the gas turbine are practiced, the gas turbine exhaust gas line and the air feed line are separated by separation means such as a damper. However, the separation is not complete. Therefore, there is the possibility that a little amount of air leaks and the leaked air flows into the gas turbine side from the boiler side through the separation means. Further, in case the boiler air feed line is provided with an air heater, the leaked air becomes a high temperature of about 300° C., so that the safety of operation at time of the maintenance and inspection of the gas turbine is lost and gas turbine parts of low heat-resistant material may be damaged.

SUMMARY OF THE INVENTION

An object of the present invention is to provide a fully-fired combined plant in which high-temperature air leaked through a damper is prevented from entering the gas turbine during independent operation of a boiler, that is, during a boiler operation under the condition that the gas turbine is stopped.

The present invention resides in a fully-fired combined plant comprising a boiler, a boiler feed air line provided with an air heater for feeding heated air to the boiler, a gas turbine, a gas turbine exhaust gas line connected to the gas turbine and the boiler feed air line downstream of the air heater for leading exhaust gas from the gas turbine into the boiler feed air line, shutting means provided on said gas turbine exhaust gas line for shutting the line at the time the gas turbine is stopped, and a ventilator provided on the gas turbine exhaust gas line on the upstream side of the shutting means with respect to a gas turbine exhaust gas flow direction for ventilating the gas turbine exhaust gas line on the upstream side of the shutting means.

In an aspect of the present invention, the ventilator comprises a duct, one end of which is connected to the gas turbine exhaust gas line and the other end of which is opened to the atmosphere, and a damper, whereby natural ventilation i.e., ventilation without forced drafting is effected.

In another aspect of the present invention, the ventilator comprises a duct, a damper and a draft fan, whereby forced ventilation is effected.

In another aspect of the present invention, the ventilator is connected to the gas turbine exhaust gas line with a boiler exhaust gas stack to lead the leaked air to the stack.

In another aspect of the present invention, the ventilator includes a pressure controller for controlling the pressure of gas turbine exhaust gas in the gas turbine exhaust gas line between the shutter means and the gas turbine.

In another aspect of the present invention, the ventilator comprises a controller for controlling operation of the shutting means and the damper.

High-temperature air leaked through the shutting means into the gas turbine exhaust gas line between the shutting means and the gas turbine is exhausted out of the gas turbine exhaust gas line by the ventilator. Therefore, the high-temperature air does not enter the gas turbine, so that gas turbine parts of low heat-resistant material are not damaged, and the safety at time of maintenance and inspection of the gas turbine can be secured.

DESCRIPTION OF EMBODIMENTS

Figure 1:
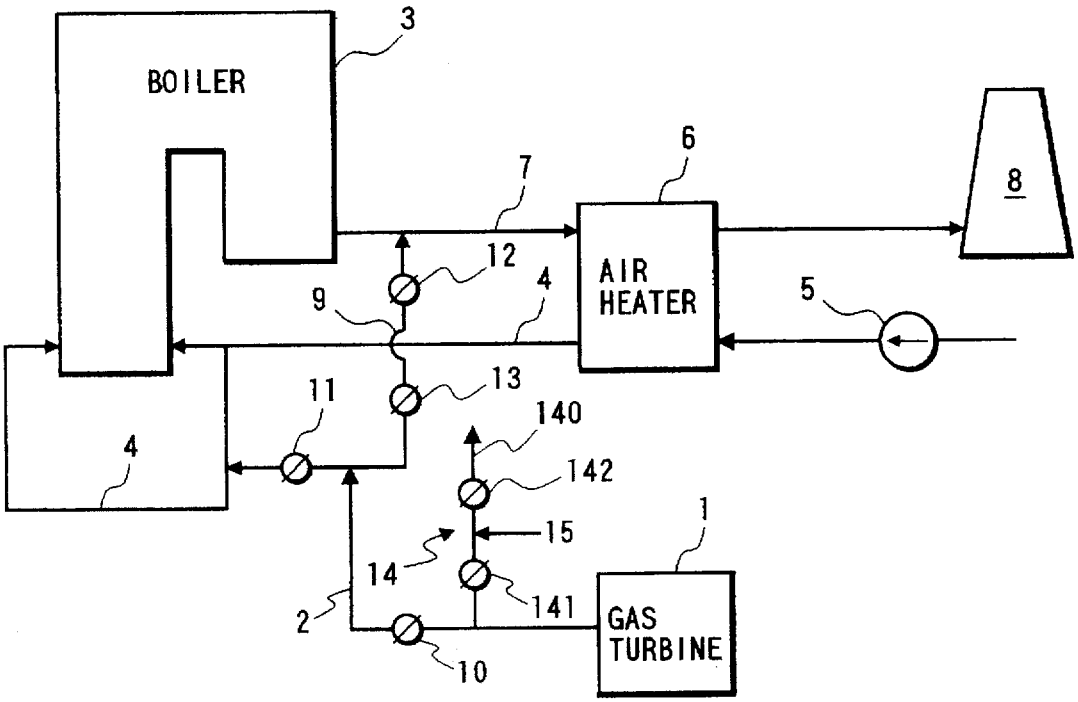
FIG. 1 is a schematic diagram of an embodiment of a fully-fired combined plant according to the present invention.

An embodiment of the present invention is described hereunder, referring to FIG. 1.

In FIG. 1, a fully-fired combined plant with a gas turbine protection apparatus is shown. The fully-fired combined plant comprises a gas turbine 1, a boiler 3, an air heater 6, a stack 8 and various fluid lines.

The boiler 3 is fed with air through a boiler feed air line 4. The boiler feed air line 4 has thereon a forced draft fan 5 for taking air therein and feeding it into the boiler 3 and the air heater 6 for heating the feed air.

Exhaust gas from the boiler 3 is led to the stack 8 through a boiler exhaust gas line 7 and wasted from the stack 8 into atmosphere. The air heater 6 is connected to the boiler exhaust gas line 7 so that the exhaust gas passing in the boiler exhaust gas line heat-exchanges with the feed air passing in the boiler feed air line 4, whereby the feed air is heated to a predetermined temperature by means of the exhaust gas and fed to the boiler 3 as combustion air.

Exhaust gas from the gas turbine 1 is fed to the boiler 3 through a gas turbine exhaust gas line 2 and the boiler feed air line 4 connected to the gas turbine exhaust gas line 2, that is, the exhaust gas is fed to the boiler 3 together with combustion air. The gas turbine exhaust gas has a high temperature of about 500° C. to 600° C. and includes oxygens of the concentration of 13% to 15%. A main aim of the fully-fired combined plant is to reduce boiler fuel consumption and to raise the plant efficiency by supplying the gas turbine exhaust gas into the boiler 3.

The fully-fired combined plant is provided with a boiler bypass line 9 which has a function of bypassing the boiler 3 to lead gas turbine exhaust gas to the boiler exhaust gas line 7, for boiler combustion adjustment at time of start-up or shut-down of the gas turbine 1.

The gas turbine exhaust gas line 2 is provided with a shutting means 10 mounted thereon for interrupting gas turbine exhaust gas flowing from the gas turbine 1 into the boiler feed air line 4. The shutting means 10 is closed at the time of independent boiler operation, and maintenance and inspection of the gas turbine are practiced at the time of closure of the shutting means.

The gas turbine exhaust gas line 2 also is provided with a damper 11 at a downstream side of the shutting means 10. The damper 11 is for adjusting a flow rate of gas turbine exhaust gas. The boiler bypass line 9 is provided with double dampers, one 12 of which is for adjusting a flow rate and the other 13 of which is for interruption of exhaust gas flow, whereby the potential that boiler exhaust gas flows reversely into the gas turbine exhaust gas line 2 is reduced.

As the shutting means 10, a sealingly closing type louver damper, a shutter damper, air-seal type damper, etc which are excellent in shutting performance can be used, for example. However, any of them is impossible to completely shut gas flow, that is, gas leaks a little, which is inevitable because of construction. Therefore, it is necessary to prevent high-temperature leaked air from flowing reversely from the boiler feed air line 4 into the gas turbine side.

In the embodiment of the invention as shown in FIG. 1, a ventilator 14 is provided on the gas turbine exhaust gas line 2 at an upstream side of the shutting means 10, that is, between the shutting means 10 and the gas turbine 1.

The ventilator 14 comprises a duct 140, one end of which is fluidly connected to the gas turbine exhaust gas line 2 at the upstream side of the shutting means 10 and the other end of which is opened to the atmosphere. Dampers 141 and 142 are mounted on the duct 140. The ventilator has a line 15 between the dampers 141 and 142 for supplying seal air into the duct 140.

With this ventilating construction, the shutting means 10 is closed during independent operation of the boiler 3, with the gas turbine 1 being stopped. Even if air leaks into the gas turbine exhaust gas line at the upstream side of the shutting means 10 through the shutting means 10, the leaked air does not enter the gas turbine 1 because the dampers 141, 142 of the ventilator 14 are opened and natural ventilation is effected utilizing natural draft force. In other words, no forced drafting is required.

Figure 2:
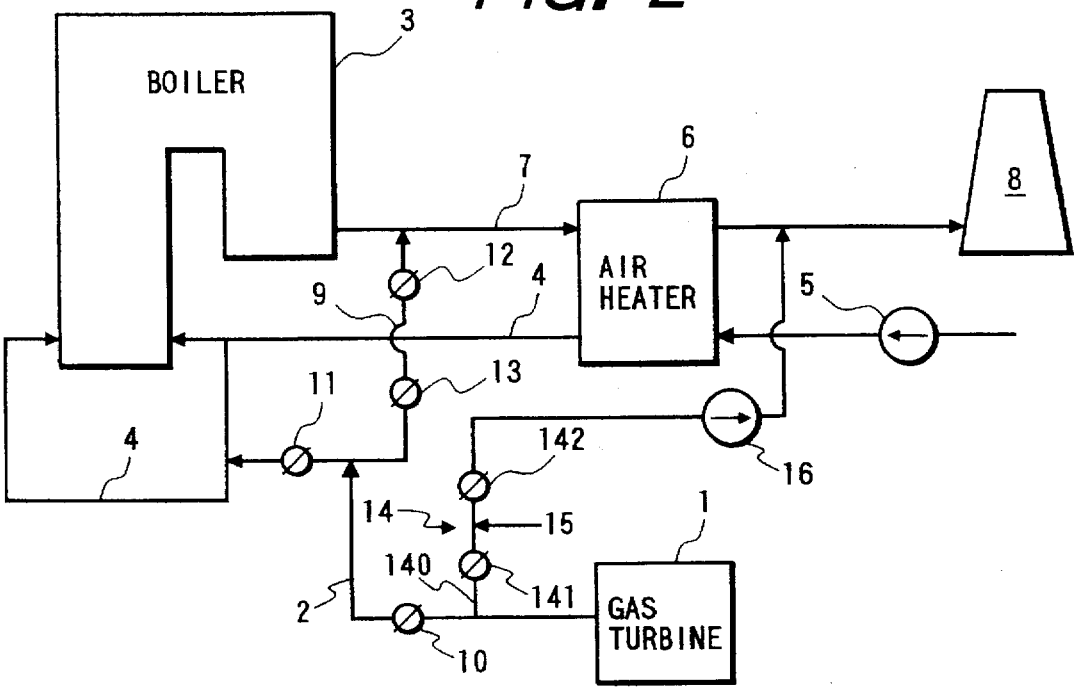
FIG. 2 is a schematic diagram of another embodiment of a fully-fired combined plant according to the present invention.

Another embodiment of the present invention is described hereunder, referring to FIG. 2. This embodiment is different from the embodiment in FIG. 1 only in a construction of ventilator 14

In FIG. 2, the ventilator 14 comprises a duct 140, one end of which is connected to the gas turbine exhaust gas line 2 between the shutting means 10 and the gas turbine 1 and the other end is connected to the boiler exhaust gas line 7 downstream of the air heater 6. Dampers 141 and 142 are mounted on the duct 140, and a ventilation fan 16 is provided for forced ventilating. The ventilator 14 also has a line 15 for supplying seal air into the duct 140.

With this ventilator 14, air leaked through the shutting means 10 is forcibly led to the boiler exhaust gas line 7 and discharged through the stack 8. In this embodiment, forced draft force is employed to prevent the leaked gas from entering the gas turbine 1.

In each of the embodiments in FIGS. 1 and 2, a plurality of the ventilators 14 can be utilized, thus, hot-temperature air leaked through the shutting means 10 and through equipment in which the pressure is less than atmospheric pressure such as the boiler exhaust gas line 7, an inlet duct of the forced draft fan 5, etc., can be discharged to the atmosphere utilizing the ventilators.

Figure 3:
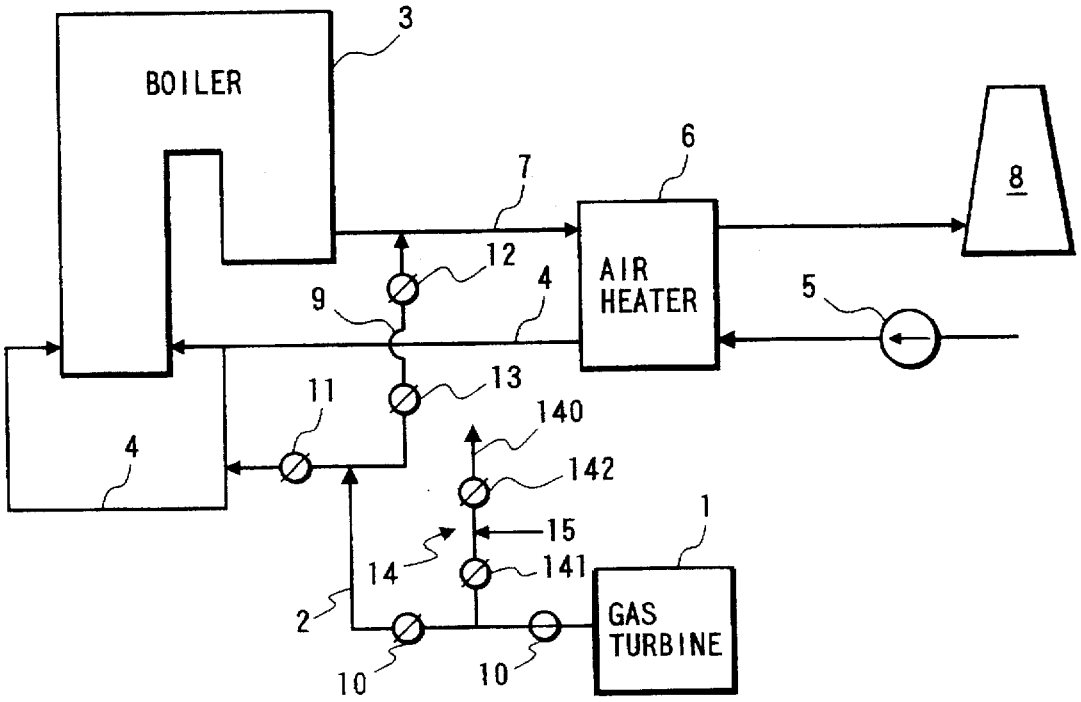
FIG. 3 is a schematic diagram of another embodiment of a fully-fired combined plant according to the present invention.

Another embodiment of the present invention is shown in FIG. 3. This embodiment differs from the embodiment in FIG. 1 in that two shutting means 10 are provided on the gas turbine exhaust gas line 2 and the ventilator 14 is connected to the gas turbine exhaust gas line 2 between the two shutting means 10. In FIG. 3, a ventilator for natural or unforced ventilation is shown. However, a ventilator utilizing forced draft force as shown in FIG. 2 can be employed instead of this ventilator 14.

Figure 4:
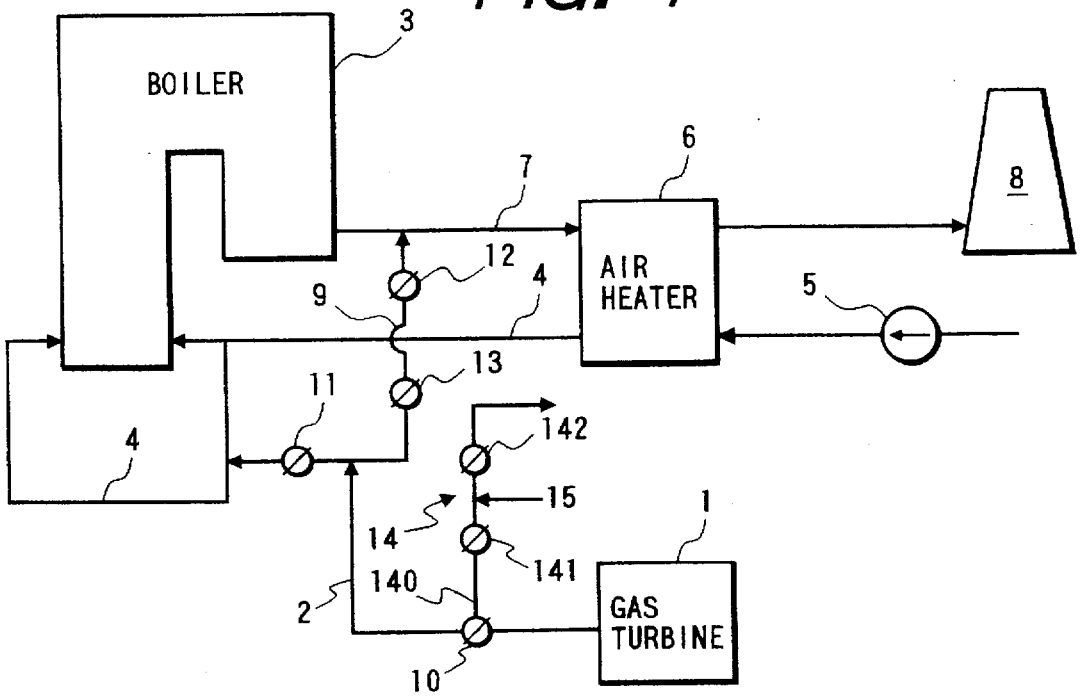
FIG. 4 is a schematic diagram of another embodiment of a fully-fired combined plant according to the present invention.

Another embodiment of the present invention is described referring to FIG. 4. The embodiment differs from the embodiment in FIG. 1 in that the ventilator 14 is connected to the shutting means 10. The shutting means is a sealingly closed type damper which has an opening port formed in a damper body. The opening port is connected to the duct of the ventilator whereby when the damper is closed, high-temperature leaked air is directed to the duct of the ventilator 14. The high-temperature leaked air can be discharged into the atmosphere.

Figure 5A:
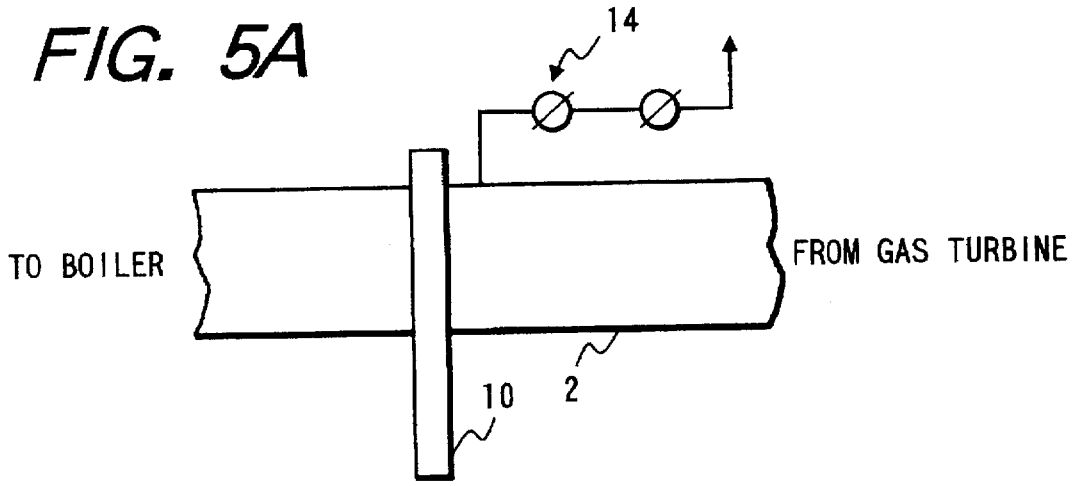
FIG. 5A is a side view showing a duct on which a ventilator is mounted.
Figure 5B:
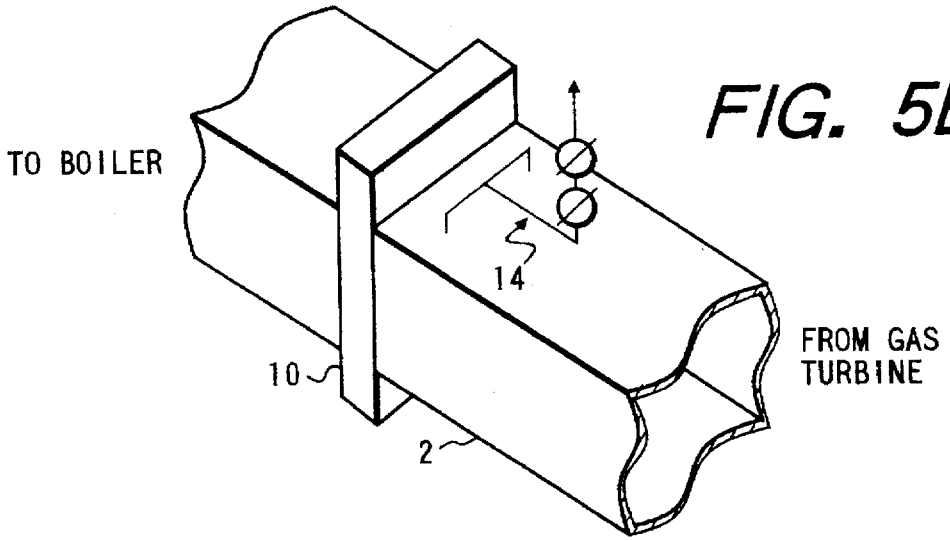
FIGS. 5B and 5C each are a perspective view of a mounting construction of a ventilator.
Figure 5C:
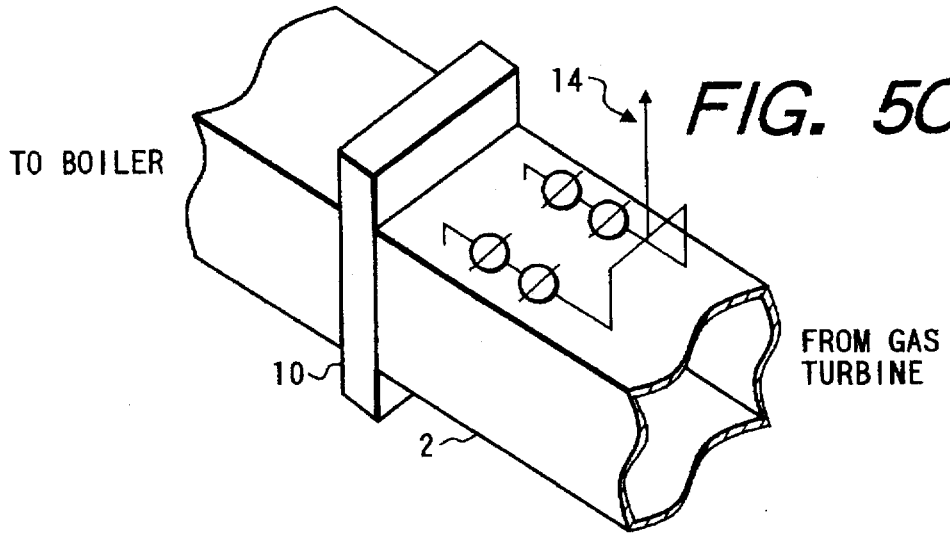

FIGS. 5A, 5B and 5C each show an example of an arrangement of a ventilator 14 in which the ventilator 14 is arranged on the gas turbine exhaust gas line 2 between the shutting means 10 and the gas turbine 1, close to the shutting means 10 and on an upper surface of a gas turbine exhaust gas duct. In FIG. 5B, the ventilator 14 has a plurality of intake ports connected to the gas turbine exhaust gas duct. In FIG. 5C, the ventilator 14 has a plurality of intake branch ducts branched from a duct and each intake branch duct has a plurality of dampers.

Figure 6:
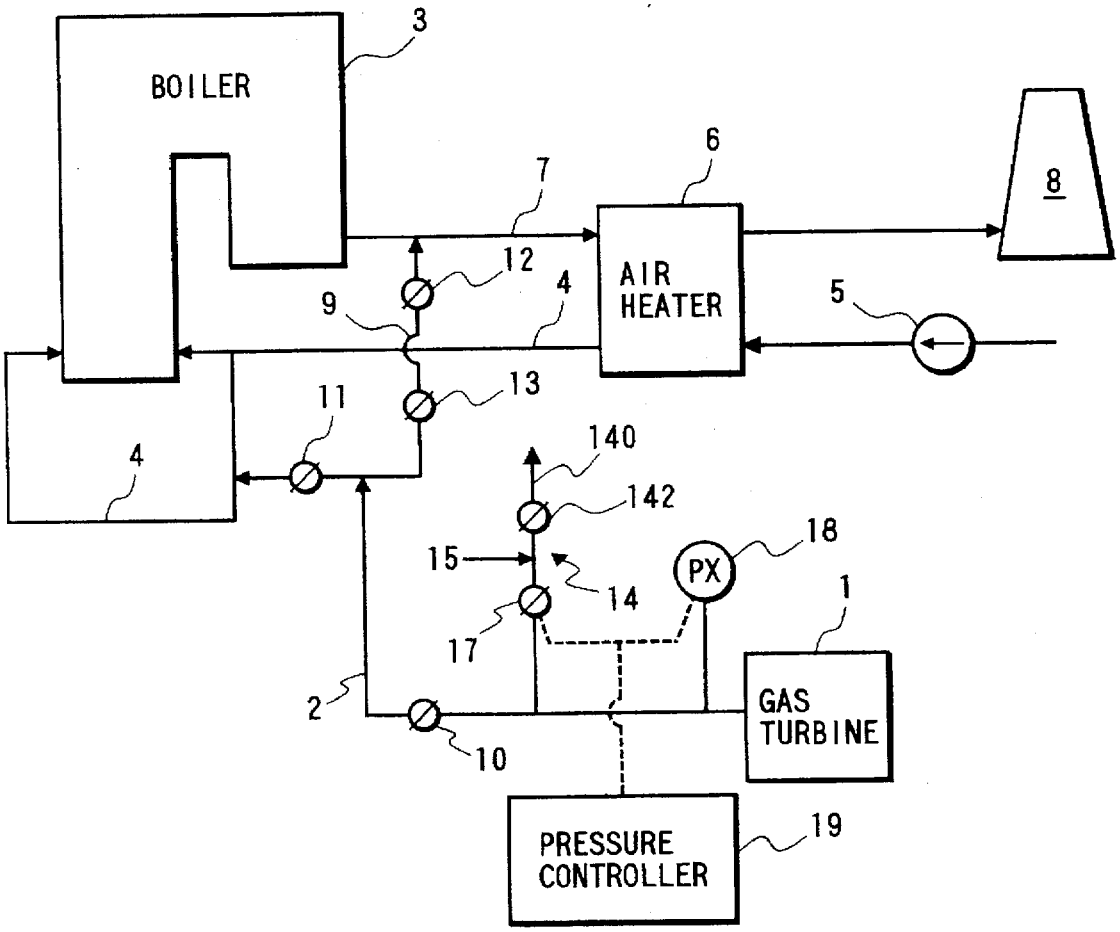
FIG. 6 is a schematic diagram of another embodiment of a fully-fired combined plant according to the present invention.

Another embodiment of the present invention is shown in FIG. 6. In FIG. 6, a ventilator 14, mounted on the gas turbine exhaust gas line 2 between the shutting means 10 and the gas turbine 1, comprises a duct 140 connected to the gas turbine exhaust gas line 2 at an upstream side of the shutting means 10, dampers 17, 142, a pressure sensor 18 connected to the gas turbine exhaust gas line 2 between the shutting means 10 and the gas turbine 1, and a pressure controller 19 electrically connected to the damper 17 and the pressure sensor 18. The pressure controller 19 inputs the pressure sensed by the pressure sensor 18 and controls the damper 17 so that the pressure will be a predetermined pressure.

Figure 7A:
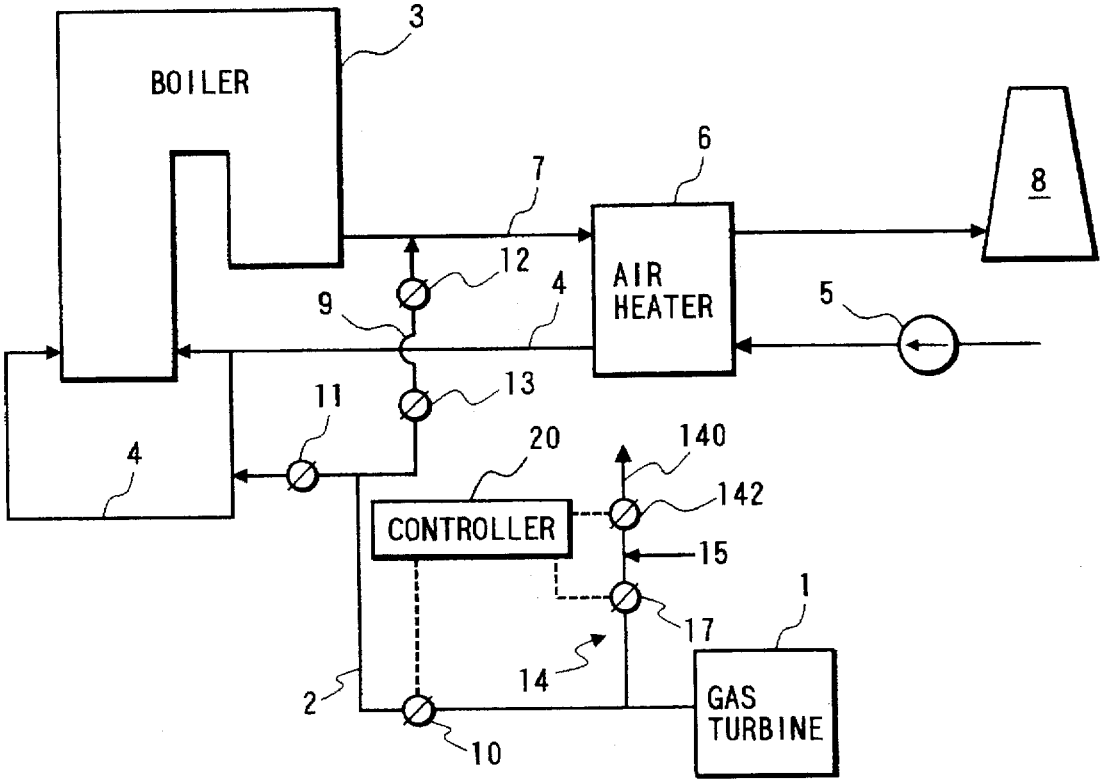
FIG. 7A is a schematic diagram of another embodiment of a fully-fired combined plant according to the present invention.
Figure 7B:
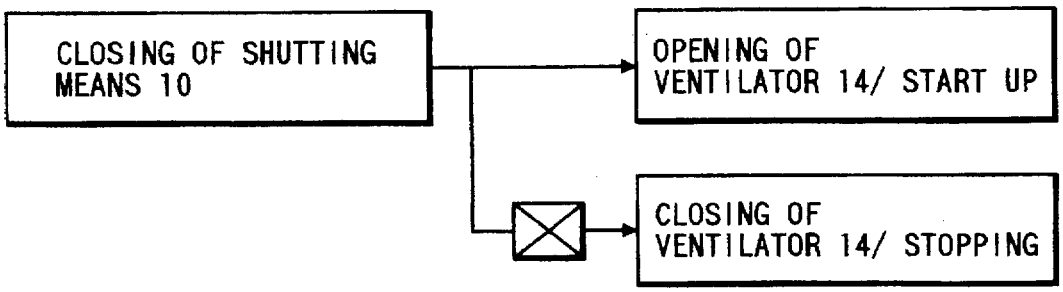
FIG. 7B is a view for explanation of operation conditions between shutting means and a ventilator.

Another embodiment of the present invention is shown in FIGS. 7A and 7B. In FIG. 7A, a ventilator 14 comprises a duct 140 connected to the gas turbine exhaust gas line 2 on the upstream side of the shutting means 10, dampers 17, 142 and a controller 20 connected to the shutting means 10 and the dampers 17,142. The controller 20 controls the shutting means 10 and the dampers 17, 142, as shown in FIG. 7B, when an instruction to close the shutting means is issued to the controller 20. That is, the controller 20 controls so that after the shutting means 10 is completely closed to shut the gas turbine exhaust gas line 2, the dampers 17 and 142 are opened at the time of start-up of the ventilator 14 and closed at the time the ventilator is stopped. When the controller 20 receives an instruction that the gas turbine has started, the controller 20 controls so that the shutting means 10 is opened under the condition that the dampers 17 and 142 are fully closed. When the ventilator 14 is provided with a ventilation fan 16 as shown in FIG. 2, the ventilation fan is operated in synchronism with operation of the dampers 17 and 142.

According to the present invention, at the time of stop of the gas turbine, high-temperature leaked air at the time of maintenance and inspection can be prevented from reversely flowing into the gas turbine, whereby safety of work at the time of maintenance and inspection of the gas turbine can be secured and damage to low temperature parts of the gas turbine can be prevented.

Further, in order to prevent reverse flow of high-temperature air at the time the gas turbine is stopped, the ventilator is controlled automatically, interlocking with the condition of closing and opening operation of the shutting means, so that manual operation of an operator is reduced.

Further, the cost of equipment for carrying out the present invention is about 1/10 or less as compared with conventional stack equipment for exclusive use of a gas turbine, and the air leak flow rate is about 1/100 or less as compared with the exhaust gas flow rate of the gas turbine, so that the required duct area of the ventilator is about 1/100 or less of the duct area of the gas turbine exhaust gas line.

What is claimed is:

1. A fully-fired combined plant comprising:

a boiler;

a boiler exhaust gas line for leading exhaust gas from said boiler to a stack;

a boiler air feed line for feeding air to said boiler;

an air heater mounted on said boiler air feed line and said boiler exhaust gas line so as to heat feed air with boiler exhaust gas;

a gas turbine;

a gas turbine exhaust gas line connected to said gas turbine and said boiler air feed line for introducing exhaust gas from said gas turbine into said boiler air feed line;

a first damper provided on said gas turbine exhaust gas line;

a boiler bypass line connected to said gas turbine exhaust gas line on an upstream side of said first damper and paid boiler exhaust gas line, said boiler bypass line having a second damper;

shutting means, provided on said gas turbine exhaust gas line on an upstream side of a connection of said boiler bypass line to said gas turbine exhaust gas line, for shutting said gas turbine exhaust gas line when the operation of said gas turbine is stopped; and a ventilator, provided on said gas turbine exhaust gas line at an upstream side of said shutting means, for ventilating said gas turbine exhaust gas line on the upstream side of said shutting means.

2. A fully-fired combined plant according to claim 1, wherein said ventilator comprises a duct, one end of which is connected to said gas turbine exhaust gas line on the upstream side of said shutting means and another end of which is opened to atmosphere, and a third damper is mounted on said duct so that ventilation to the atmosphere is allowed by operation of said third damper.

3. A fully-fired combined plant according to claim 1, wherein said ventilator comprises a duct fluidly connected to said gas turbine exhaust gas line on the upstream side of said shutting means, a damper mounted on said duct, and a ventilation fan mounted on said duct for effecting forced ventilation.

4. A fully-fired combined plant according to claim 3, wherein said duct is connected to said stack, so that the forced ventilation is effected through said stack.

5. A fully-fired combined plant according to claim 1, wherein said ventilator comprises a pressure controller controlling the pressure in said gas turbine exhaust gas line.

6. A fully-fired combined plant according to claim 1, wherein said ventilator comprises a controller for controlling operation of said ventilator so that when said shutting means is opened, said ventilator is closed and when said shutting means is closed said ventilator is opened.

7. A fully-fired combined plant according to claim 6, wherein said ventilator comprises a duct connected to said gas turbine exhaust gas line, and at least one damper mounted on said duct, and said controller is electrically connected to said shutting means and said at least one damper, for controlling said shutting means and said at least one damper.

8. A fully-fired combined plant comprising:

a boiler;

a boiler exhaust gas line for leading exhaust gas from said boiler to a stack;

a boiler air feed line for feeding air to said boiler;

an air heater mounted on said boiler air feed line and said boiler exhaust gas line so as to heat feed air with boiler exhaust gas;

a gas turbine;

a gas turbine exhaust gas line connected to said gas turbine and said boiler air feed line at a downstream side of said air heater for introducing exhaust gas from said gas turbine into said boiler air feed line, said gas turbine exhaust gas line having a gas turbine exhaust gas line damper;

a boiler bypass line connected to said gas turbine exhaust gas line on an upstream side of said damper and said boiler exhaust gas line, said boiler bypass line having a bypass line damper;

shutting means, provided on said gas turbine exhaust gas line at an upstream side of a connection of said boiler bypass line with said gas turbine exhaust gas line, for shutting said gas turbine exhaust gas line when operation of said gas turbine is stopped; and a ventilator, provided on said gas turbine exhaust gas line at an upstream side of said shutting means, for ventilating said gas turbine exhaust gas line on the upstream side of said shutting means.

9. A fully-fired combined plant according to claim 8, wherein said ventilator comprises a duct connected to said gas turbine exhaust gas line on the upstream side of said shutting means, and a duct damper mounted on said duct.

10. A fully-fired combined plant according to claim 9, wherein said ventilator comprises a controller for controlling operation of said shutting means and said duct damper according to a predetermined operating relationship between said shutting means and said duct damper.

11. A fully-fired combined plant according to claim 1, wherein said ventilator includes a controller for controlling said shutting means and said ventilator so as to operate said ventilator after said shutting means is closed, and to open said shutting means after said ventilator is stopped.

12. A fully-fired combined plant according to claim 1, wherein said ventilator comprises a duct connected to said gas turbine exhaust gas line between said gas turbine and said shutting means, a third damper provided on said duct, a fourth damper provided on said duct on the downstream of said third damper, and a line provided on said duct between said third and fourth dampers for supplying air into said duct, and wherein said controller is electrically connected to said shutting means and said third and fourth dampers, for controlling said shutting means and said third and fourth dampers so that after said shutting means is closed, said third and fourth dampers are opened, and after said third and fourth dampers are closed said shutter means is opened.

13. A fully-fired combined plant comprising:

a boiler;

a boiler exhaust gas line for leading exhaust gas from said boiler to a stack;

a boiler air feed line for feeding air to said boiler;

an air heater mounted on said boiler air feed line and said boiler exhaust gas line so as to heat feed air with boiler exhaust gas;

a gas turbine;

a gas turbine exhaust gas line, connected to said gas turbine and said boiler air feed line, for introducing exhaust gas from said gas turbine into said boiler air feed line;

shutting means, provided on said gas turbine exhaust gas line, for shutting said gas turbine exhaust gas line when operation of said gas turbine is stopped; and a ventilator, provided on said gas turbine exhaust gas line at an upstream side of said shutting means, for ventilating said gas turbine exhaust gas line on the upstream side of said shutting means, and wherein said ventilator comprises a duct connected to said gas turbine exhaust gas line between said gas turbine and said shutting means, a first damper provided on said duct, a second damper provided on said duct on a downstream side of said first damper, a line provided on said duct between said first and second dampers for supplying air into said duct, and a controller, electrically connected to said shutting means and said first and second dampers, for controlling operations said first and second damper and said shutter means.

* * * * *